US006593693B1

(12) United States Patent
Takagi et al.

(10) Patent No.: US 6,593,693 B1
(45) Date of Patent: Jul. 15, 2003

(54) PLASMA DISPLAY PANEL WITH REDUCED PARASITIC CAPACITANCE

(75) Inventors: Akihiro Takagi, Kawasaki (JP); Tadatsugu Hirose, Kawasaki (JP); Shigeki Kameyama, Kawasaki (JP); Tomokatsu Kishi, Kawasaki (JP); Noriaki Setoguchi, Kawasaki (JP)

(73) Assignee: Fujitsu Limited, Kawasaki (JP)

( * ) Notice: Subject to any disclaimer, the term of this patent is extended or adjusted under 35 U.S.C. 154(b) by 29 days.

(21) Appl. No.: 09/595,911

(22) Filed: Jun. 20, 2000

(30) Foreign Application Priority Data

Jun. 30, 1999 (JP) ..... 11-185627

(51) Int. Cl.[7] ..... H01J 17/49
(52) U.S. Cl. ..... 313/586; 313/582; 313/493
(58) Field of Search ..... 313/586, 587, 313/583, 584, 485, 489, 491, 493, 509, 582

(56) References Cited

U.S. PATENT DOCUMENTS 3,926,763 A * 12/1975 Reisman ..... 204/192.37
3,993,921 A * 11/1976 Robinson ..... 313/586
4,853,590 A * 8/1989 Andreadakis ..... 313/485
5,703,437 A * 12/1997 Komaki ..... 313/587
5,742,122 A * 4/1998 Amemiya et al. ..... 313/582
5,962,975 A * 10/1999 Lepselter ..... 313/586
6,084,349 A * 7/2000 Ueoka et al. ..... 313/587
6,160,345 A * 12/2000 Tanaka et al. ..... 313/489
6,255,780 B1 * 7/2001 Komaki et al. ..... 313/586
6,326,727 B1 * 12/2001 Chung ..... 313/586
6,346,772 B1 * 2/2002 Nishiki et al. ..... 313/587

FOREIGN PATENT DOCUMENTS

JP 7-226164 8/1995
JP 9-35641 2/1997

* cited by examiner

*Primary Examiner*—Michael H. Day
*Assistant Examiner*—Kevin Quarterman
(74) *Attorney, Agent, or Firm*—Staas & Halsey LLP

(57) ABSTRACT

A plasma display panel having a high power efficiency by reducing parasitic capacitances comprises first and second substrates disposed facing each other, a plurality of address lines formed on the first substrate and extending along a first direction and a plurality of X and Y electrodes formed on the second substrate and extending along a second direction crossing the first direction. A first dielectric layer covers the X and Y electrodes formed on the second substrate, the first dielectric layer having a dielectric constant higher than a dielectric constant of the second substrate, and a trench formed at least through the first dielectric layer in an area between two adjacent X and Y electrodes, the trench extending along the second direction. Alternatively, a plurality of projections extends along the second direction, crossing the first direction, a plurality of X and Y electrodes being formed on the second substrate along the projections, the X and Y electrodes, respectively, being formed in opposite side areas of each projection, and a dielectric layer covering each of the X and Y electrodes and formed in the opposite side areas of each projection on the second substrate, the dielectric layer having a dielectric constant higher than a dielectric constant of the second substrate.

33 Claims, 8 Drawing Sheets

PLASMA DISPLAY PANEL WITH REDUCED PARASITIC CAPACITANCE

This application claims priority on Japanese Patent Application HEI 11-185627, filed on Jun. 30, 1999, the entire contents of which are incorporated herein by reference.

BACKGROUND OF THE INVENTION a) Field of the Invention

The present invention relates to a plasma display panel, and more particularly to a three-electrode type plasma display panel having, on its one substrate, X electrodes as common electrodes and Y electrodes as scan electrodes.

b) Description of the Related Art

A three-electrode type plasma display panel has: a plurality of address electrodes on an opposing surface of one of a pair of substrates; and a plurality pair of retaining electrodes crossing the address electrodes on an opposing surface of the other of the pair of substrates.

Each retaining electrode pair has an X electrode and a Y electrode. The surface of the retaining electrode is covered with a high dielectric layer having a high dielectric constant. Discharge gas such as Ne+Xe at a predetermined pressure is filled in the space between opposing substrates. Fluorescent members of predetermined colors are disposed on the address electrodes.

As a voltage corresponding to an image signal and being higher than a threshold voltage is applied between selected Y and address electrodes, discharge gas in the crossed space between the electrodes starts discharging, and electric charges are stored on the surface of the high dielectric layer. In a similar manner, a voltage corresponding to an image signal is applied between a next selected Y electrode and the address electrode.

After electric charges of one frame are stored, a voltage whose polarities are alternately reversed is applied between X and Y electrodes. Electric charges stored in the upper area of the Y electrode move to the upper area of the X electrode, and next to the upper area of the Y electrode. Electric charges alternately move between the upper areas of X and Y electrodes to retain electric discharge. Ultraviolet rays or the like radiated by electric discharge make the fluorescent member in a corresponding area develop color.

Multi-level gradation display becomes possible by combining radiations of light having different discharge times. If X and Y electrodes of each retaining electrode are made of a wide transparent electrode and a narrow bus electrode having a low resistance, radiation light transmitted through the transparent electrode can be observed externally and the low wiring resistance can achieve a high speed operation.

In order to store electric charges in the upper area of the Y electrode (and X electrode), it is preferable to cover the retaining electrode with a dielectric layer. It is more preferable if the dielectric constant of the dielectric layer is made higher, in order to store electric charges as much as possible. A higher dielectric constant of the dielectric layer is more preferable in order to apply a division voltage, as high as possible, to the space between opposing substrates when a predetermined voltage is applied between the address electrode and Y electrode.

X and Y electrodes of each retaining electrode are disposed near to each other. A parasitic capacitance between X and Y electrodes, therefore, becomes large. Power consumed to charge this parasitic capacitance is a reactive power not contributing to light radiation.

SUMMARY OF THE INVENTION

It is an object of the present invention to provide a plasma display panel having a high power efficiency.

It is another object of the present invention to provide a plasma display panel having a small charge current.

It is still another object of the present invention to provide a plasma display panel capable of high speed operation.

According to one aspect of the present invention, there is provided a plasma display panel comprising: first and second substrates disposed facing each other; a plurality of address lines formed on the first substrate and extending along a first direction; a plurality set of X and Y electrodes formed on the second substrate and extending along a second direction crossing the first direction; a high dielectric layer covering the X and Y electrodes formed on the second substrate, the high dielectric layer having a dielectric constant higher than a dielectric constant of the second substrate; and a trench formed at least through the high dielectric layer in an area corresponding to an area between the X and Y electrodes of each set, the trench extending along the second direction.

The high dielectric layer is removed at least in the area corresponding to the area between the X and Y electrodes of each set so that parasitic capacitances of the X and Y electrodes are reduced. A power required for charging the X and Y electrodes is lowered and the power efficiency is improved. The charge current for the same charge time can be reduced and the charge time for the same charge current can be shortened. A high speed operation is made possible.

As the charge storage area is increased to store a large amount of charges, the discharge start voltage can be lowered.

As the discharge space is formed between the X and Y electrodes, a spatial discharge as well as a surface discharge can be generated.

According to another aspect of the present invention, there is provided a plasma display panel comprising: a transparent first substrate; a plurality of address lines formed on the first substrate and extending along a first direction; a second substrate having a plurality of projections extending along a second direction crossing the first direction; a plurality set of X and Y electrodes formed on the second substrate along the projections, each set being formed in both side areas of each projection; and a high dielectric layer covering the X and Y electrodes and formed in both side areas of each projection on the second substrate, the high dielectric layer having a dielectric constant higher than a dielectric constant of the second substrate.

As the dielectric constant between the X and Y electrodes is lowered, the parasitic capacitances of the X and Y electrodes can be reduced. Therefore, a power required for charging the X and Y electrodes is lowered and the power efficiency is improved. The charge current for the same charge time can be reduced and the charge time for the same charge current can be shortened. A high speed operation is possible.

As above, the parasitic capacitances of electrodes of a plasma display panel can be reduced and a low power consumption can be realized.

The charge current can be reduced and the charge time can be shortened. The discharge start voltage is expected to be lowered.

DETAILED DESCRIPTION OF THE PREFERRED EMBODIMENTS

Embodiments of the invention will be described with reference to the accompanying drawings.

Figure 4A:
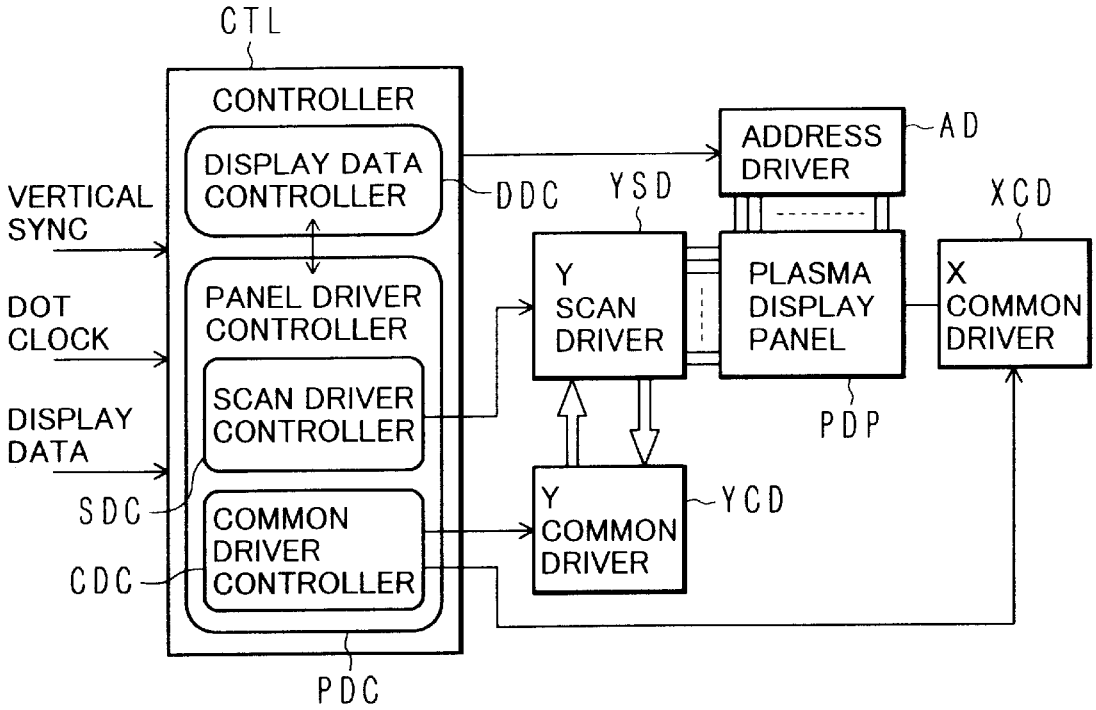
FIGS. 4A and 4B are an equivalent circuit diagram showing the whole circuit of a plasma display panel, and a schematic perspective view showing the whole structure of the panel.
Figure 4B:
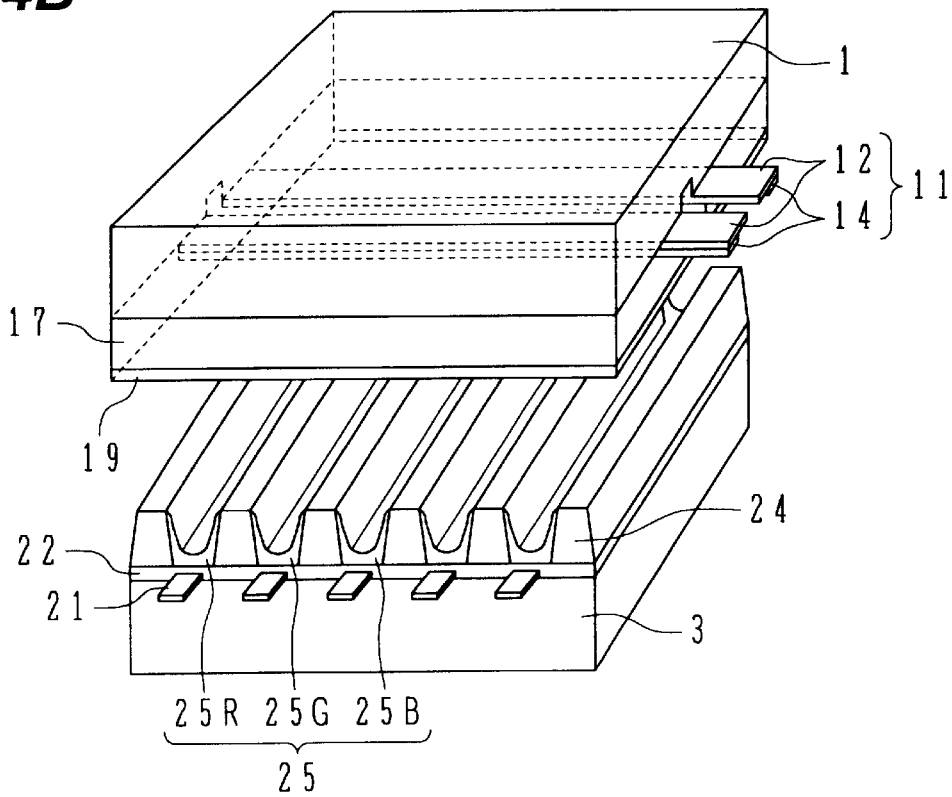

FIGS. 4A and 4B show the whole circuit of a plasma display panel and the structure of its display portion.

As shown in FIG. 4A, a display unit of a plasma display panel PDP is connected to an address driver AD, a Y scan driver YSD, and an X common driver XCD. The Y scan driver YSD is also connected to a Y common driver YCD.

These peripheral circuits are controlled by signals sent from a controller CTL. The controller CTL is externally supplied with a vertical sync signal, a dot clock, and display data. The controller CTL has a display data controller DDC and a panel drive controller PDC. The panel drive controller PDC has a scan driver controller SDC and a common driver controller CDC.

The scan driver controller SDC selects one Y electrode. In response to signals supplied from the address driver AD, address lines are selected which correspond to selected addresses where the selected Y electrode crosses and electric discharge is generated to store electric charges and illuminate corresponding pixels. Then, the next Y electrode is selected and corresponding address lines are selected to store electric charges. In this manner, the whole frame is scanned.

After electric charges are stored for the whole frame, the X common driver XCD and Y common driver YCD are operated to supply a voltage with alternately reversing polarities across the X and Y electrodes to alternately move stored electric charges between X and Y electrodes. In this manner, electric discharge is retained. This electric discharge generates plasma to emit light from fluorescent members.

FIG. 4B is a schematic diagram showing the structure of the display unit. A front glass substrate 1 and a back glass substrate 3 are disposed in parallel, facing each other. On the opposing surface of the front glass substrate 1, a pair of display electrodes 12 constituting the X and Y electrodes and a pair of bus electrodes 14 are formed to constitute a retaining electrode 11. The bus electrodes 14 are formed on the display electrodes 12. A plurality of retaining electrodes each constituted of a set of electrodes described above are formed in parallel on the front glass substrate 1.

A plurality of retaining electrodes 11 are covered with a high dielectric layer 17 having a dielectric constant higher than the substrate 1. The surface of the high dielectric layer 17 is covered with a protection layer 19 made of MgO or the like. The protection layer 19 prevents the high dielectric layer 17 from being sputtered by plasma.

On the surface of the back glass substrate 3, a plurality of address electrodes 21 are formed extending in a direction crossing the retaining electrodes 11. The address electrodes 21 are covered with a high dielectric layer 22 having a dielectric constant higher than the substrate 3. Projecting partitions 24 are formed on the surface of the high dielectric layer 22 in such a shape as separating the address electrodes. For example, the partitions 24 are formed by forming a mask film and performing sand blast (selective removal). The high dielectric layers 17 and 22 and partitions 24 are made of a mixture of, for example, $PbO_x$, $SiO_2$ and $B_2O_3$, or the like.

Fluorescent members 25 are formed in recesses between the partitions by printing techniques or the like. A set of a fluorescent member 25R for red light radiation, a fluorescent member 25G for green light radiation and a fluorescent member 25B for blue light radiation is disposed repetitively.

The display electrode 12 is made of transparent electrode material such as indium tin oxide (ITO). The bus electrode 14 and address electrode 21 are made of high conductivity metal such as Cr, Al, W, Cu, Au and Pt or lamination of these metals such as Cr/Cu/Cr.

The structure of the retaining electrode and its peripheral area of the front glass substrate will be described mainly.

Figure 1A:
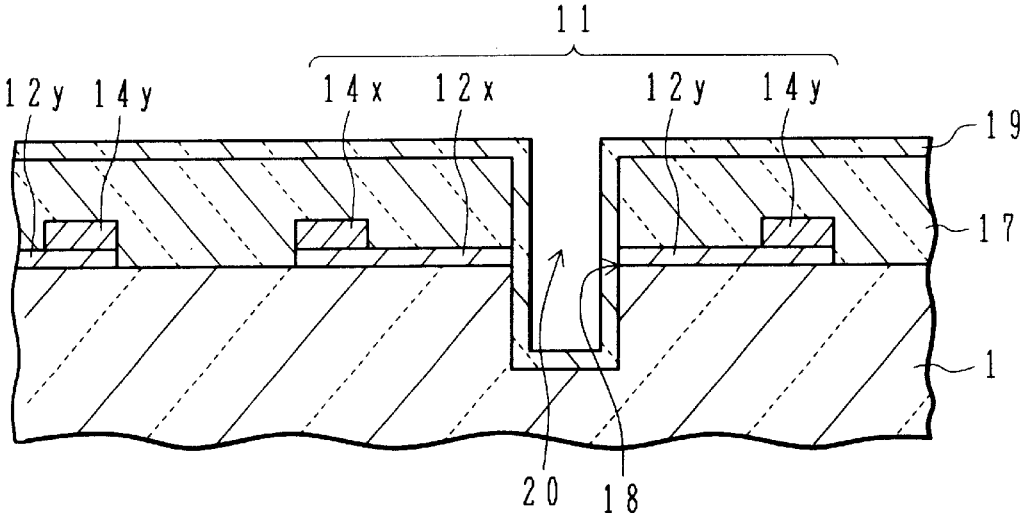
FIGS. 1A and 1B are cross sectional views of a substrate structure of a plasma display panel according to an embodiment of the invention.
Figure 1B:
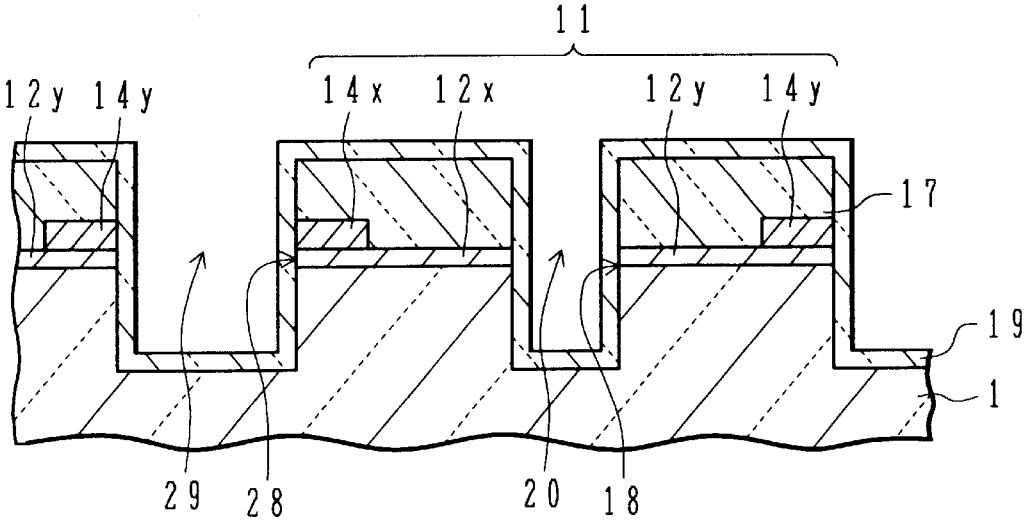

FIGS. 1A and 1B show the substrate structure having a trench between X and Y electrodes of a retaining electrode according to an embodiment of the invention.

As shown in FIG. 1A, a combination of transparent electrodes 12 and bus electrodes 14 formed on the surface of a front glass substrate 1 forms X electrodes 12*x* and 14*x* and Y electrodes 12*y* and 14*y* which constitute a retaining electrode 11. Reference numeral 12 is a general reference numeral for 12*x* and 12*y*, and reference numeral 14 is a general reference numeral for 14*x* and 14*y*. The surface of the retaining electrode 11 is covered with a high dielectric layer 17 having a dielectric constant higher than the substrate 1. A trench 18 is formed from the surface of the high dielectric layer 17 to a predetermined depth of the glass substrate 1. The trench 18 extends over the whole length of the retaining electrode 11.

The trench 18 is preferably formed to reach one end of the X electrode 12*x* and one end of the Y electrode 12*y*. The predetermined depth of the trench in the substrate is preferably set to 100 $\mu$m or deeper. However, it is preferable that the depth is set to a half of the thickness of the substrate or shallower in order to maintain the strength of the substrate.

A protection film 19 of MgO or the like covers the surfaces of the high dielectric layer 17 and trench 18.

With this structure, capacitances between the X electrodes 12*x* and 14*x* and the Y electrodes 12*y* and 14*y* reduce because the effective dielectric constant of medium between the electrodes is lowered by the trench 18. Therefore, parasitic capacitances of the X and Y electrodes reduce and the charge amount necessary for charging to a predetermined voltage can be reduced. This means that a drive power of the plasma display panel can be lowered and that the charge current for the same charge time can be reduced and the charge time for the same charge current can be shortened.

Further, a space 20 in the trench between the X and Y electrodes becomes a discharge space. Namely, not only surface discharge similar to conventional techniques occurs, but also spatial or opposing discharge between the X and Y electrodes can occur. It is therefore possible to store more electric charges than conventional, and electric discharge can be expected to be retained more easily.

In the example shown in FIG. 1A, the trench is formed in the retaining electrode to reduce parasitic capacitance between X and Y electrodes of the retaining electrode. A plurality of retaining electrodes each having X and Y electrodes are disposed in parallel. Therefore, parasitic capacitance are also formed between X and Y electrodes of adjacent retaining electrodes.

FIG. 1B shows the substrate structure having a trench formed between X and Y electrodes of adjacent retaining electrodes. In FIG. 1B, a trench 18 between X electrodes 12*x* and 14*x* and Y electrodes 12*y* and 14*y* and a discharge space 20 shown in the central area are similar to those shown in FIG. 1A. The structure shown in FIG. 1B has a trench 28 formed between Y electrodes 12*y* and 14*y* and the X electrodes 12*x* and 14*x* of adjacent retaining electrodes. The surface of the trench 28 is also covered with a protection layer 19 to form a recess 29.

The recess 29 is a non-discharge space and does not contribute to display. However, as compared to a substrate whose area corresponding to the recess 29 is made of the substrate 1 and high dielectric layer 17, this recess 29 lowers the effective dielectric constant, and parasitic capacitances between the X electrodes 12*x* and 14*x* and Y electrodes 12*y* and 14*y* reduce. Therefore, as compared to the structure shown in FIG. 1A, the parasitic capacitance of the retaining electrode reduces more. A reduced power consumption, and a reduced charge current or a shortened charge time can therefore be expected.

FIGS. 2A to 2F are cross sectional views illustrating an example of a manufacture method for the structure shown in FIG. 1A.

Figure 2A:
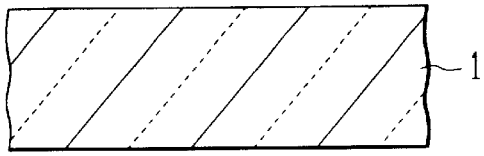
FIGS. 2A to 2F are cross sectional views illustrating an example of a manufacture method for the substrate structure shown in FIG. 1A.

As shown in FIG. 2A, a glass substrate 1 for a front glass substrate is prepared.

Figure 2B:
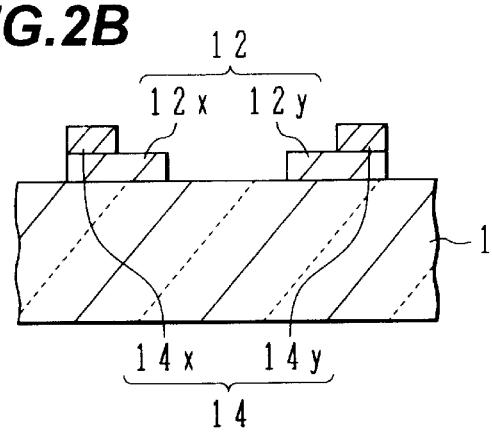

As shown in FIG. 2B, transparent electrodes 12*x* and 12*y* are formed on the surface of the glass substrate 1, and bus electrodes 14*x* and 14*y* are formed on the transparent electrodes. These electrodes may be formed by sputtering and patterning process utilizing photoresist.

Figure 2C:
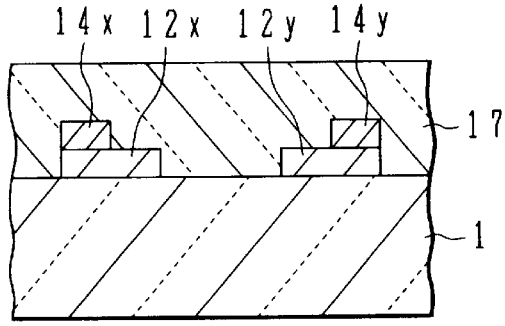

As shown in FIG. 2C, a high dielectric layer 17 is formed covering the retaining electrode having X and Y electrodes 12 and 14. The high dielectric layer 17 may be made of a mixture of, for example, $PbO_x$, $SiO_2$ and $B_2O_3$.

Figure 2D:
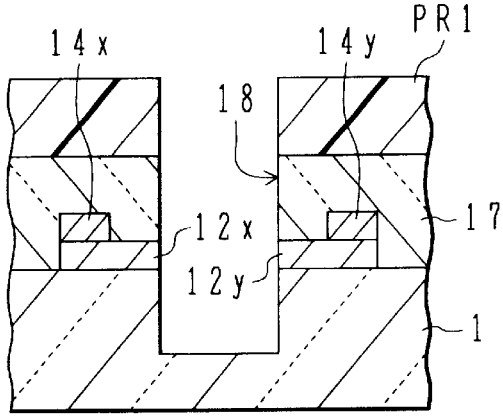

As shown in FIG. 2D, a resist pattern PR1 is formed on the surface of the high dielectric layer 17, and the high dielectric layer 17 between the X and Y electrodes and the surface layer of the substrate 1 are etched. A trench 18 is therefore formed between the X and Y electrodes. The resist pattern PR1 is thereafter removed.

Figure 2E:
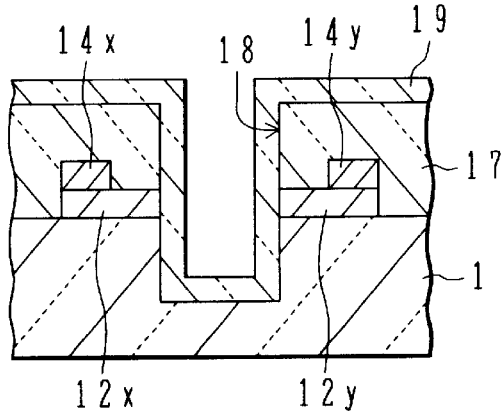

As shown in FIG. 2E, a protection layer 19 of MgO or the like is formed on the surfaces of the high dielectric layer 17 and trench 18. For example, the protection layer 19 is formed by sputtering.

Figure 2F:
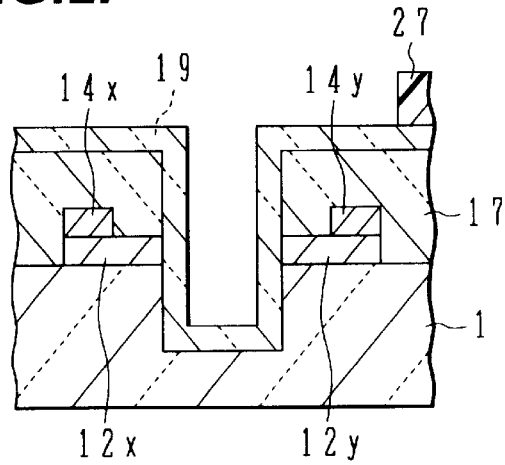

As shown in FIG. 2F, a seal 27 is formed on the peripheral upper surface of the substrate.

Thereafter, the front substrate 1 and a back glass substrate 3 are bonded together by the seal 27. A plasma display substrate having a discharge space can thus be formed.

The back glass substrate can be formed by a method similar to conventional techniques. FIGS. 3A to 3E are cross sectional views illustrating an example of a manufacture method for a back glass substrate.

Figure 3A:
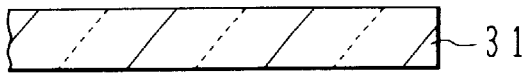
FIGS. 3A to 3E are cross sectional views illustrating an example of a manufacture method for a back substrate.

As shown in FIG. 3A, a glass substrate 31 for a back glass substrate is prepared.

Figure 3B:
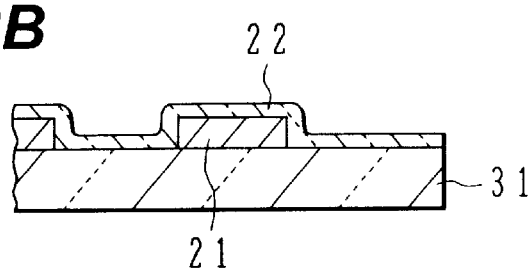

As shown in FIG. 3B, a plurality of address lines 21 are formed on the surface of the glass substrate 31. The address line 21 may be formed by depositing a metal layer and pattering it by using a resist pattern. A high dielectric layer 22 having a dielectric constant higher than the glass substrate 31 is formed on the substrate 31, covering the address lines 21.

Figure 3C:
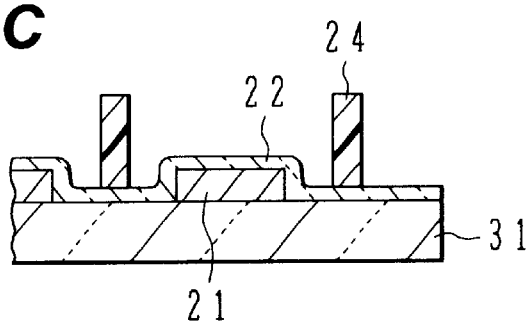

As shown in FIG. 3C, partitions 24 are formed on the high dielectric layer 22. The partition 24 is formed between adjacent address lines 21 and projects higher than the address line 21.

Figure 3D:
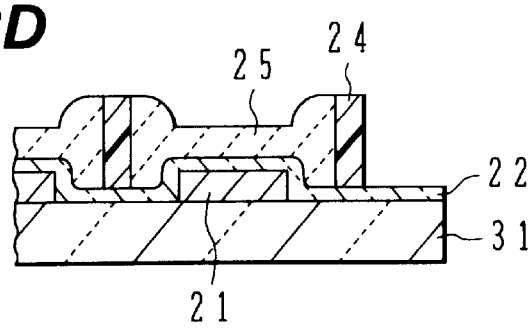

As shown in FIG. 3D, a fluorescent layer 25 is formed in a space between adjacent partitions 24. For example, the fluorescent layer is formed by printing to make the surface thereof between the partitions 24 concave. For example, the fluorescent layer 25 is formed to occupy about one third of the space between the partitions.

Figure 3E:
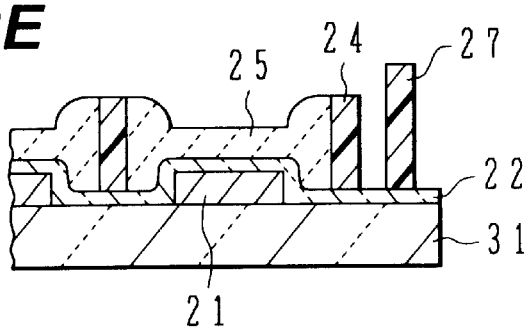

As shown in FIG. 3E, a seal 27 is formed on the peripheral upper surface of the substrate if necessary. The seal 27 is formed at least on one of the front substrate and the back substrate side. Thereafter, the front substrate and the back substrate are assembled to form a plasma display panel.

Methods of reducing parasitic capacitances of X and Y electrodes of the retaining electrode are not limited only to the methods described above.

Figure 5A:
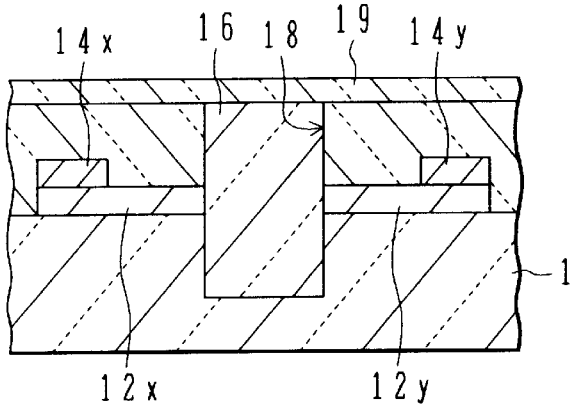
FIGS. 5A to 5D are schematic cross sectional views showing the substrate structure of a plasma display panel and its manufacture method according to another embodiment of the invention.

FIGS. 5A is a cross sectional view showing an example of the substrate structure capable of reducing parasitic capacitances of X and Y electrodes and having a flat surface.

As shown in FIG. 5A, X electrodes 12*x* and 14*x* and Y electrodes 12*y* and 14*y* are formed on the surface of a glass substrate 1 and a high dielectric layer 17 is covering these electrodes. In an area between the X and Y electrodes, a trench 18 is formed through the high dielectric layer 17 and a surface layer of the substrate 1. This structure is similar to that shown in FIG. 1A.

In the structure of this embodiment, the trench 18 is buried with a low dielectric material 16 having a dielectric constant lower than the substrate 1. The surfaces of the low dielectric region 16 and high dielectric layer 17 are made flush through polishing or the like. On this flat common surface, a protection layer 19 is formed. Since the low dielectric region 16 has a dielectric constant lower than the substrate 1 and high dielectric layer 17, parasitic capacitances of the X and Y electrodes can be reduced.

Figure 5B:
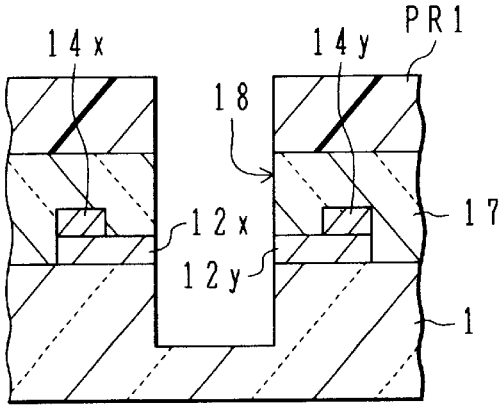
Figure 5C:
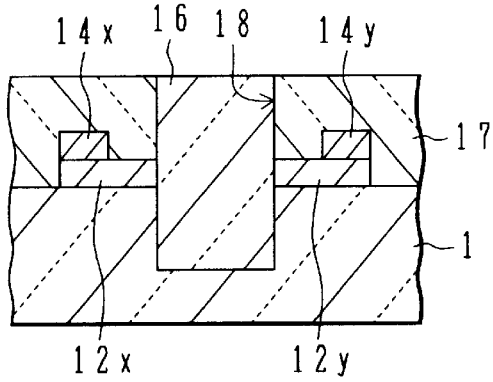
Figure 5D:
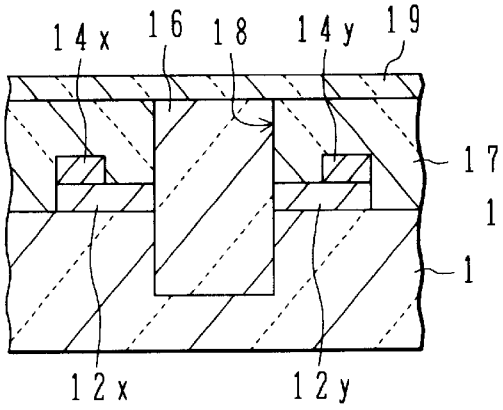

FIGS. 5B to 5D are cross sectional views illustrating an example of a manufacture method for the structure shown in FIG. 5A.

As shown in FIG. 5B, after a transparent electrode layer 12, a bus electrode layer 14 and a high dielectric layer 17 are formed on a substrate 1, a resist pattern PR1 is formed on the surface of the high dielectric layer 17, and a trench 18 is formed in an area between X and Y electrodes. The processes up to this are similar to those shown in FIGS. 2A to 2D. The resist pattern PR1 is thereafter removed.

As shown in FIG. 5C, a low dielectric material 16 is filled in the trench 18. If the low dielectric material is fluid such as resin and spin on glass, the fluid is coated on the substrate surface and excessive fluid on the surface is removed. The low dielectric material may also be deposited by sputtering and the surface thereof is planarized by chemical mechanical polishing.

As shown in FIG. 5D, after the flat surfaces of the high dielectric layer 17 and low dielectric area 16 are formed, a protection layer 19 is deposited on this common flat surface by sputtering. The structure shown in FIG. 5A can be formed by the processes described as above.

Figure 5E:
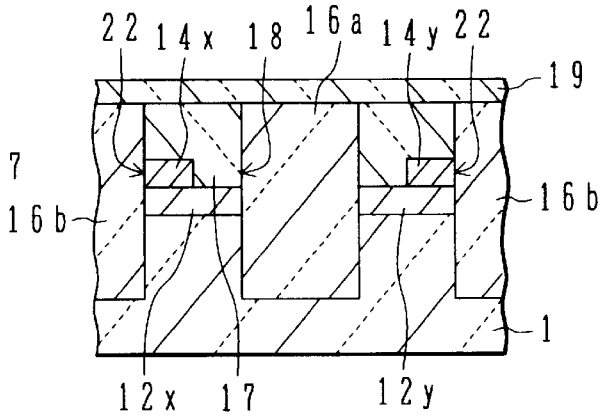
FIG. 5E is a schematic cross sectional view showing another substrate structure.

In this structure, the trench formed between the X and Y electrodes is buried with the low dielectric material. Instead, as shown in FIG. 5E, in addition to the trench 18 in the retaining electrode, another trench 22 between X and Y electrodes of adjacent retaining electrodes may be formed. In this case, the trench 18 is buried with a low dielectric region 16a and the trench 22 is buried with a low dielectric region 16*b*.

FIGS. 6A to 6E are cross sectional views illustrating another manufacture method for the structure shown in FIG. 5A.

Figure 6A:
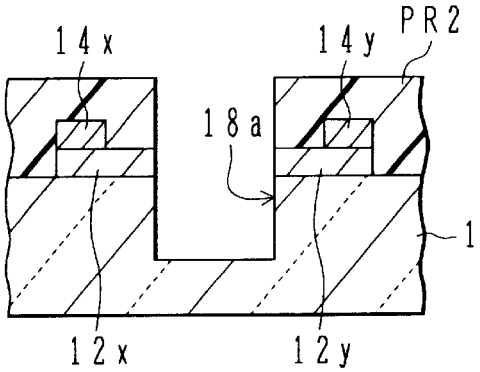
FIGS. 6A to 6E are schematic cross sectional views showing an example of another manufacture method for the structure shown in FIG. 5A.

As shown in FIG. 6A, after transparent electrodes 12 and bus electrodes 14 are formed on a substrate 1, a resist pattern PR2 is formed having an opening in an area corresponding to the area between X and Y electrodes. By using this resist pattern PR2 as a mask, the substrate 1 is etched to form a trench 18*a*. The resist pattern PR2 is thereafter removed.

Figure 6B:
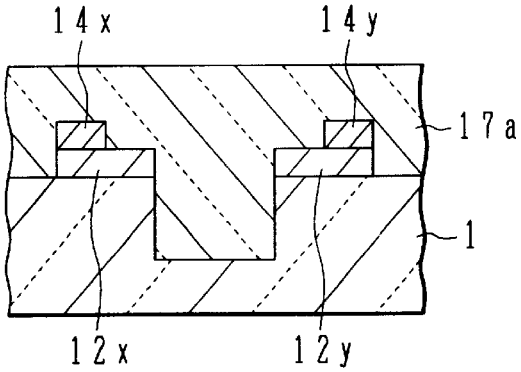

As shown in FIG. 6B, a high dielectric layer 17*a* is formed covering the substrate 1, transparent electrodes 12 and bus electrodes 14.

Figure 6D:
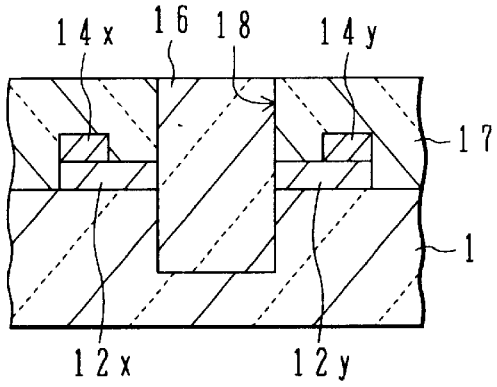
Figure 6C:
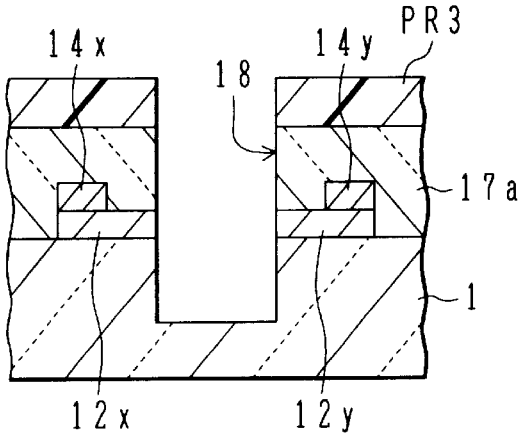

As shown in FIG. 6C, a resist pattern PR3 having a pattern similar to the resist pattern PR2 is formed on the high dielectric layer 17*a*. By using this resist pattern PR3 as a mask, the high dielectric layer 17*a* and substrate 1 are etched. This etching etches only the high dielectric layer 17*a* between the X and Y electrodes and the substrate 1 is not required to be etched. The resist pattern PR3 is thereafter removed.

As shown in FIG. 6D, the trench 18 is buried with low dielectric material to form a low dielectric region 16.

Thereafter, similar to the process shown in FIG. 5D, a protection layer is formed on the surfaces of the low dielectric region 16 and high dielectric layer 17. The structure shown in FIG. 5A can therefore be formed.

Although the trench is formed in the substrate 1 already formed with the X and Y electrodes, another manufacture method may be adopted.

Figure 6E:
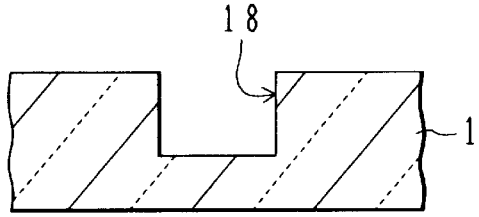

As shown in FIG. 6E, a trench 18 is formed in a substrate 1, and thereafter X and Y electrodes are formed on the upper surface of the substrate 1 to follow the processes similar to those described above.

Parasitic capacitances of X and Y electrodes may be reduced by lowering an effective dielectric constant of an underlie substrate.

Figure 7A:
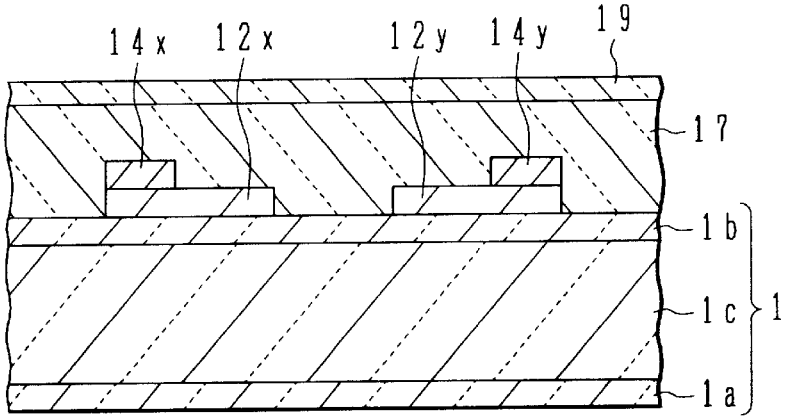
FIGS. 7A to 7D are schematic cross sectional views showing the substrate structures of a plasma display panel and its manufacture method according to still another embodiment of the invention.

FIG. 7A shows another example of the substrate structure capable of reducing the parasitic capacitances of X and Y electrodes. In this structure, a substrate 1 is not a single layer glass substrate, but is constituted of a pair of thin glass substrates 1*a* and 1*b* and a low dielectric layer 1*c* formed between the substrates 1*a* and 1*b*. For example, the low dielectric layer 1*c* is made of resin having a low dielectric constant. The low dielectric layer 1*c* may be replaced with a vacant space.

Figure 7B:
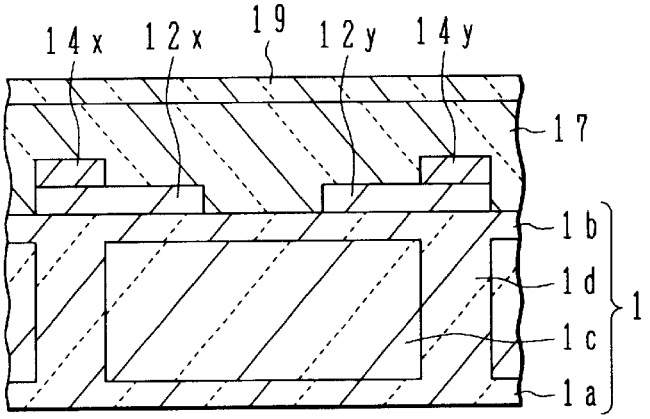

FIG. 7B shows a modification of the structure shown in FIG. 7A. In FIG. 7B, a glass substrate 1 is constituted of a thin lower glass substrate 1*a*, a thin upper glass substrate 1*b*, and ribs 1*d* coupling the substrates 1*a* and 1*b*. Between each pair of the ribs 1*d* is a region (i.e., a cutaway region, a vacant space or low dielectric material region) 1*c*. This structure can increase the strength of the substrate 1 compared to the structure without ribs.

Figure 7C:
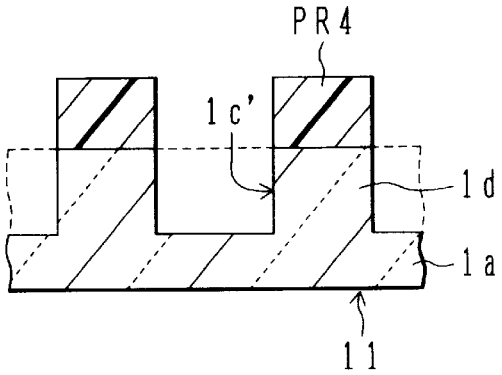
Figure 7D:
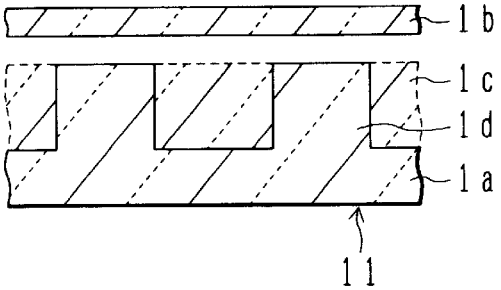

FIGS. 7C and 7D are cross sectional views illustrating an example of a manufacture method for the substrate 1 shown in FIG. 7B.

As shown in FIG. 7C, a resist pattern PR4 is formed on the surface of a glass substrate 11 to etch the substrate 11 through openings of the resist pattern PR4. This etching etches predetermined surface areas of the glass substrate 11 to form trenches 1*c*'. An unetched bottom area of the substrate 11 is a glass substrate 1*a*. Areas between the trenches 1*c*′ are ribs 1*d*. After this etching, the resist pattern PR4 is removed. Thereafter, low dielectric material 1*c* if necessary is filled in the trenches 1*c*′ as shown in FIG. 7D, and another thin glass substrate 1*b* is bonded to the ribs 1*d*. The composite glass substrate 1 shown in FIG. 7B can therefore be formed.

Figure 8A:
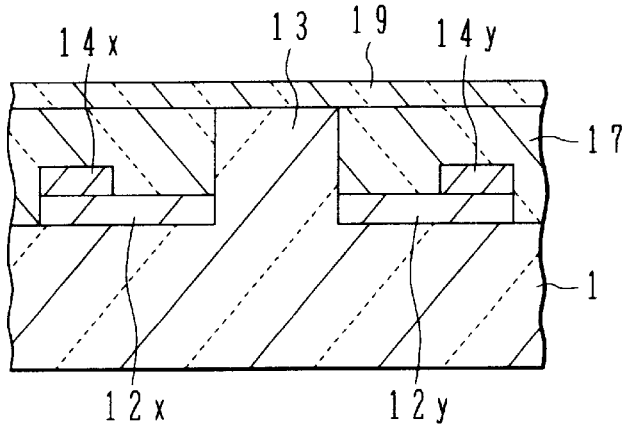
FIGS. 8A to 8D are schematic cross sectional views showing the substrate structure of a plasma display panel and its manufacture method according to still another embodiment of the invention.

FIG. 8A shows another substrate structure. In this structure, a glass substrate 1 has a stripe projection 13 between X and Y electrodes. Namely, the X and Y electrodes are separated by the stripe projection 13. A high dielectric layer 17 is formed covering the X and Y electrodes similar to the other structures described earlier. A protection layer 19 is formed on the surfaces of the high dielectric layer 17 and stripe projection 13. The stripe projection 13 is made of the same material as the glass substrate 1 and has a dielectric constant lower than the high dielectric layer 17. Therefore, as compared to the case where this area is made of a high dielectric layer, parasitic capacitances of the X and Y electrodes can be reduced more.

Figure 8B:
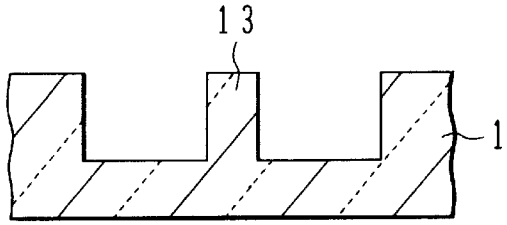
Figure 8C:
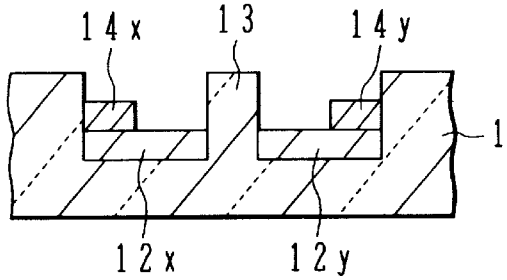
Figure 8D:
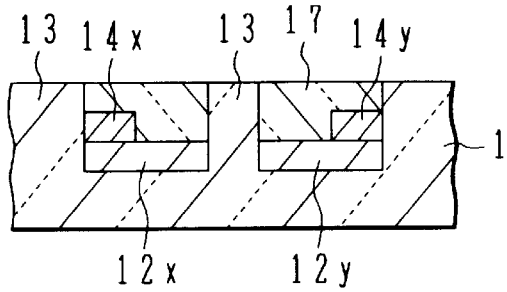

FIGS. 8B to 8D are cross sectional views illustrating an example of a manufacture method for the structure shown in FIG. 8A.

As shown in FIG. 8B, trenches are formed in surface areas of a glass substrate 1 to leave stripe projection areas 13 between adjacent trenches. For example, this etching may be performed by the process shown in FIG. 7C.

As shown in FIG. 8C, transparent electrodes 12*x* and 12*y* are formed, and bus electrodes 14*x* and 14*y* are formed on the transparent electrodes 12*x* and 12*y*.

As shown in FIG. 8D, the insides of the trenches are buried with a high dielectric layer 17, which has a dielectric constant higher than that of the substrate. Thereafter, a protection layer 19 is formed on the surface of the substrate to complete the structure shown in FIG. 8A. It is preferable to form the stripe glass areas 13 also between the X and Y electrodes of adjacent retaining electrodes. Parasitic capacitances of the X and Y electrodes can be reduced.

The present invention has been described in connection with the preferred embodiments. The invention is not limited only to the above embodiments. For example, the structures shown in FIGS. 7A and 7B and FIG. 8A may be applied to an address electrode substrate to reduce the parasitic capacitances of address electrodes. A combination of trenches and projections may be employed. It will be apparent to those skilled in the art that various modifications, improvements, combinations, and the like can be made.

What is claimed is:

1. A plasma display panel, comprising:

first and second substrates disposed facing each other;

a plurality of address lines formed on said first substrate and extending along a first direction;

a dielectric coating covering the address lines formed on said first substrate and having a dielectric constant higher than a dielectric constant of said first substrate;

a plurality of X and Y electrodes formed on said second substrate and extending along a second direction crossing the first direction;

a first dielectric layer covering the X and Y electrodes formed on said second substrate, said first dielectric layer having a dielectric constant higher than a dielectric constant of said second substrate; and a trench formed at least through said first dielectric layer in an area between two adjacent X and Y electrodes, said trench extending along the second direction.

2. The plasma display panel according to claim 1, further comprising:

a rib formed between adjacent address lines on said first substrate; and a fluorescent member formed between adjacent ribs and covering each address line on said first substrate.

3. The plasma display panel according to claim 1, wherein said trench extends to an inside of said second substrate.

4. The plasma display panel according to claim 1, further comprising:

a protection layer covering surfaces of said first dielectric layer and said trench.

5. The plasma display panel according to claim 1, further comprising:

a second dielectric area having a dielectric constant lower than the dielectric constant of said first dielectric layer, said second dielectric area being buried in said trench.

6. The plasma display panel according to claim 5, further comprising:

a protection layer covering surfaces of said first dielectric layer and said second dielectric area.

7. The plasma display panel according to claim 1, further comprising:

one or more other trenches formed at least through said first dielectric layer and extending along the second direction such that any two adjacent X and Y electrodes sandwich one of the trenches therebetween.

8. The plasma display panel according to claim 7, further comprising:

a protection layer covering surfaces of said first dielectric layer.

9. The plasma display panel according to claim 7, further comprising:

another second dielectric area buried in each of said one or more other trenches, said another second dielectric area having a dielectric constant lower than the dielectric constant of said first dielectric layer.

10. The plasma display panel according to claim 9, further comprising:

a protection layer covering surfaces of said first dielectric layer.

11. A plasma display panel comprising:

first and second substrates disposed facing each other;

a plurality of address lines formed on said first substrate and extending along a first direction; and a plurality of X and Y electrodes formed on said second substrate and extending along a second direction crossing the first direction, said second substrate having a stripe-shaped cut-away region disposed within said second substrate and corresponding to each two adjacent X and Y electrodes, said stripe-shaped cut-away region extending along the second direction.

12. The plasma display panel according to claim 11, further comprising:

a rib formed between adjacent address lines on said first substrate; and a fluorescent member formed between adjacent ribs and covering each address line on said first substrate.

13. The plasma display panel according to claim 11, further comprising:

a protection layer covering said stripe-shaped cut-away region; and a buried region provided in said stripe-shaped cut-away region under the protection layer, said buried region having a dielectric constant lower than a dielectric constant of said second substrate.

14. A plasma display panel comprising:

a first substrate;

a plurality of address lines formed on said first substrate and extending along a first direction;

a second substrate disposed to face said first substrate, and having a plurality of stripe projections extending along a second direction crossing the first direction, the stripe projections being made of a same material as the second substrate;

a plurality of X and Y electrodes formed on said second substrate along the stripe projections, said X and Y electrodes, respectively, sandwiching one of the stripe projections; and a dielectric layer covering each of the X and Y electrodes and formed in opposite side areas of each projection on said second substrate, said dielectric layer having a dielectric constant higher than a dielectric constant of said second substrate.

15. The plasma display panel according to claim 14, further comprising:

a rib formed between adjacent address lines on said first substrate; and a fluorescent member formed between adjacent ribs and covering each address line on said first substrate.

16. The plasma display panel according to claim 14, further comprising:

a protection layer covering surfaces of the projections of said second substrate and said dielectric layer.

17. The plasma display panel according to claim 14, further comprising:

one or more other projections formed on said second substrate extending along the second direction such that any two adjacent X and Y electrodes sandwich one of the projections therebetween.

18. The plasma display panel according to claim 17, further comprising:

a protection layer covering surfaces of the projections of said second substrate, and said dielectric layer.

19. A plasma display panel, comprising:

first and second substrates disposed facing each other;

a plurality of address lines formed on said first substrate and extending along a first direction;

a plurality of X and Y electrodes formed on said second substrate and extending along a second direction crossing the first direction;

a first dielectric layer covering the X and Y electrodes formed on said second substrate, said first dielectric layer having a dielectric constant higher than a dielectric constant of said second substrate; and a trench formed through said first dielectric layer and part of a thickness of the second substrate in an area between two adjacent X and Y electrodes, said trench extending along the second direction.

20. The plasma display panel according to claim 19, further comprising:

a rib formed between adjacent address lines on said first substrate; and a fluorescent member formed between adjacent ribs and covering each address line on said first substrate.

21. The plasma display panel according to claim 19, further comprising:

a protection layer covering surfaces of said first dielectric layer and said trench.

22. The plasma display panel according to claim 19, further comprising:

a second dielectric area having a dielectric constant lower than the dielectric constant of said first dielectric layer, said second dielectric area being buried in said trench.

23. The plasma display panel according to claim 22, further comprising:

a protection layer covering surfaces of said first dielectric layer and said second dielectric area.

24. The plasma display panel according to claim 19, further comprising:

one or more other trenches formed at least through said first dielectric layer and extending along the second direction such that any two adjacent X and Y electrodes sandwich one of the trenches therebetween.

25. The plasma display panel according to claim 24, further comprising:

a protection layer covering surfaces of said first dielectric layer.

26. The plasma display panel according to claim 24, further comprising:

another second dielectric area buried in each of said one or more other trenches, said another second dielectric area having a dielectric constant lower than the dielectric constant of said first dielectric layer.

27. The plasma display panel according to claim 26, further comprising:

a protection layer covering surfaces of said first dielectric layer.

28. A plasma display panel, comprising:

first and second substrates disposed facing each other;

a plurality of address lines formed on said first substrate and extending along a first direction;

a plurality of X and Y electrodes formed on said second substrate and extending along a second direction crossing the first direction;

a first dielectric layer covering the X and Y electrodes formed on said second substrate, said first dielectric layer having a dielectric constant higher than a dielectric constant of said second substrate;

a trench formed at least through said first dielectric layer in an area between two adjacent X and Y electrodes, said trench extending along the second direction; and a second dielectric area having a dielectric constant lower than the dielectric constant of said first dielectric layer, said second dielectric area being buried in said trench.

29. The plasma display panel according to claim 28, further comprising:

a protection layer covering surfaces of said first dielectric layer and said second dielectric area.

30. A plasma display panel, comprising:

first and second substrates disposed facing each other;

a plurality of address lines formed on said first substrate and extending along a first direction;

a plurality of X and Y electrodes formed on said second substrate and extending along a second direction crossing the first direction;

a first dielectric layer covering the X and Y electrodes formed on said second substrate, said first dielectric layer having a dielectric constant higher than a dielectric constant of said second substrate;

a trench formed at least through said first dielectric layer in an area between two adjacent X and Y electrodes, said trench extending along the second direction;

one or more other trenches formed at least through said first dielectric layer and extending along the second direction such that any two adjacent X and Y electrodes sandwich one of the trenches therebetween; and another second dielectric area buried in each of said one or more other trenches, said another second dielectric area having a dielectric constant lower than the dielectric constant of said first dielectric layer.

31. The plasma display panel according to claim 30, further comprising:

a protection layer covering surfaces of said first dielectric layer.

32. A plasma display panel comprising:

first and second substrates disposed facing each other, said second substrate having upper and lower substrate regions;

a plurality of address lines formed on said first substrate and extending along a first direction; and a plurality of X and Y electrodes formed on said second substrate and extending along a second direction crossing the first direction, said second substrate having a stripe-shaped cut-away region disposed within said second substrate between said upper and lower substrate regions and separated by adjacent ribs, said stripe-shaped cut-away region corresponding to each two adjacent X and Y electrodes and extending along the second direction.

33. The plasma display panel according to claim 32, further comprising:

a protection layer covering said stripe-shaped cut-away region; and a buried region provided in said stripe-shaped cut-away region under the protection layer, said buried region having a dielectric constant lower than a dielectric constant of said second substrate.

* * * * *